US006255807B1

(12) United States Patent
Doorenbos et al.

(10) Patent No.: US 6,255,807 B1
(45) Date of Patent: Jul. 3, 2001

(54) BANDGAP REFERENCE CURVATURE COMPENSATION CIRCUIT

(75) Inventors: Jerry L. Doorenbos; David M. Jones, both of Tucson, AZ (US)

(73) Assignee: Texas Instruments Tucson Corporation, Tucson, AZ (US)

( * ) Notice: Subject to any disclaimer, the term of this patent is extended or adjusted under 35 U.S.C. 154(b) by 0 days.

(21) Appl. No.: 09/691,638

(22) Filed: Oct. 18, 2000

(51) Int. Cl.[7] ..... G05F 3/16
(52) U.S. Cl. ..... 323/314; 323/315; 323/907
(58) Field of Search ..... 323/313, 314, 323/315, 316, 907

(56) References Cited

U.S. PATENT DOCUMENTS

| | | | | |
|---|---|---|---|---|
| 4,250,445 | | 2/1981 | Brokaw | 323/313 |
| 4,443,753 | | 4/1984 | McGlinchey | 323/313 |
| 4,587,478 | * | 5/1986 | Kasperkovitz et al. | 323/316 |
| 4,603,291 | | 7/1986 | Nelson | 323/315 |
| 4,633,165 | | 12/1986 | Pietkiewicz et al. | 323/314 |
| 4,939,442 | | 7/1990 | Carvajal et al. | 323/907 |
| 5,291,122 | | 3/1994 | Audy | 323/313 |
| 5,307,007 | | 4/1994 | Wu et al. | 323/313 |
| 5,352,973 | * | 10/1994 | Audy | 323/313 |
| 5,391,980 | | 2/1995 | Thiel et al. | 323/314 |
| 5,519,308 | | 5/1996 | Gilbert | 323/313 |
| 5,604,427 | * | 2/1997 | Kimura | 323/907 |
| 5,910,726 | * | 6/1999 | Koifman et al. | 323/315 |
| 5,920,184 | * | 7/1999 | Kadanka | 323/314 |
| 6,016,051 | * | 1/2000 | Can | 323/315 |
| 6,111,396 | * | 8/2000 | Lin et al. | 323/313 |
| 6,111,397 | * | 8/2000 | Leung | 323/907 |
| 6,181,121 | * | 1/2001 | Kirkland et al. | 323/314 |

* cited by examiner

*Primary Examiner*—Jeffrey Sterrett
(74) *Attorney, Agent, or Firm*—Snell & Wilmer L.L.P.

(57) ABSTRACT

A temperature curvature compensation technique and circuit can be realized through the generation of a temperature curvature compensation voltage provided by measuring the difference between the base-emitter voltage $V_{be}$ of two different transistors operating at two different temperature coefficient quiescent currents. This voltage difference measured between two such transistors results in a scaled voltage that is representative of the temperature curvature of the base-emitter voltage $V_{be}$ of a transistor, and which can then be summed to the bandgap reference output to provide a temperature compensated, bandgap reference voltage. The above method can be carried out in an amplifier circuit configured to receive and sum the temperature curvature compensation voltage and the bandgap reference output voltage into the temperature compensated, bandgap reference voltage. In addition, the summing of the temperature curvature compensation voltage and the bandgap reference output voltage may be realized through the application of a dual differential pair amplifier configuration which operates as a $g_m$ source. Further, scaling of the respective input voltages for each differential pair can be provided by the amplifier circuit. Moreover, the dual differential pair amplifier may be incorporated into a buffer amplifier configuration to receive a bandgap reference voltage and provide a buffered output or, integrated with a bandgap reference circuit directly into an amplifier circuit.

35 Claims, 5 Drawing Sheets

BANDGAP REFERENCE CURVATURE COMPENSATION CIRCUIT

FIELD OF THE INVENTION

The present invention relates to a bandgap reference for use in integrated circuits. More particularly, the present invention relates to a method and circuit for compensation of the temperature curvature characteristics of bandgap references used in providing accurate voltage references for various integrated circuits.

BACKGROUND OF THE INVENTION

The demand for less expensive, and yet more reliable integrated circuit components for use in communication, imaging and high-quality video applications continues to increase rapidly. As a result, integrated circuit manufacturers are requiring greater accuracy in voltage references for such components and devices to meet the design requirements of such a myriad of emerging applications.

Voltage references are generally required to provide a substantially constant output voltage despite gradual or momentary changes in input voltage, output current or temperature. In particular, many designers have utilized bandgap reference circuits due to their ability to provide a stable voltage supply that is insensitive to temperature variations over a wide temperature range. These bandgap references rely on certain temperature-dependent characteristics of the base-emitter voltage, $V_{be}$, of a transistor. Typically, these bandgap reference circuits operate on the principle of compensating the negative temperature coefficient of a bipolar transistor's base-emitter voltage, $V_{be}$, with the positive temperature coefficient of the thermal voltage, i.e., with $V_{Thermal}$=kT/q, where k is Boltzmann's constant, T is the absolute temperature in degrees Kelvin, and q is the electronic charge. In general, the negative temperature coefficient of the base-emitter voltage $V_{be}$ is summed with the positive temperature coefficient of the thermal voltage $V_{Thermal}$, which is appropriately scaled such that the resultant summation provides a zero temperature coefficient. One such well-known method is the Brokaw bandgap cell, as shown in FIG. 1.

While the bandgap reference is configured to be independent of temperature, or at least linear with temperature, in practice the bandgap reference will typically produce a reference voltage having a derivative of zero for only one given temperature. This characteristic of the bandgap reference is mainly due to the fact that the $V_{be}(T)$ term is a non-linear function. In other words, an inherent variation exists for the base-emitter voltage $V_{be}$ of a transistor with respect to temperature. In particular, the bandgap reference generates a strong second-order term that varies with Tln(T), and which limits the temperature drift performance of such a reference, i.e., causes deviation of the reference voltage with temperature. While these second order terms may be relatively small, their impact can prove highly undesirable for many applications.

Various methods have been used to compensate for the temperature curvature characteristics for bandgap references. These methods have included the addition of circuitry which first attempts to measure the temperature curvature of the base-emitter voltage $V_{be}$, and then sum the measured temperature curvature term with the bandgap reference output. Other methods have included the addition of circuitry that approximates the temperature curvature with a squared function of the temperature, such as by utilizing a proportional-to-absolute-temperature PTAT current through a resistor having a given temperature coefficient TC. While these methods may be utilized with some success, limitations exist over process variations or over a wide range of temperature, such as between the range of −50° C. to 150° C. Most notably, many of these methods have been configured to address applications utilizing bipolar transistors, but can not be utilized effectively with CMOS applications. This limitation of prior art methods results in part because CMOS processes typically have one parasitic vertical bipolar transistor whose collector is configured in a manner that limits the use of vertical bipolar transistor to that of an emitter follower, thus limiting the application of such techniques to CMOS processes.

Others have attempted to provide a bandgap reference voltage for CMOS processes through the comparison of MOS source-gate voltages to perform curvature compensation. However, these approximation techniques have not proven to be as successful as required by emerging applications.

Accordingly, as one will appreciate, a need exist for an improved temperature curvature compensation method and circuit for bandgap references, and in particular one that may be utilized effectively in CMOS applications.

SUMMARY OF THE INVENTION

The method and circuit according to the present invention addresses many of the shortcomings of the prior art. In accordance with various aspects of the present invention, a temperature curvature compensation technique and circuit can be realized through the generation of a temperature curvature compensation voltage provided by measuring the difference between the base-emitter voltage $V_{be}$ of two different transistors operating at two different temperature coefficient quiescent currents. This voltage difference measured between two such transistors results in a scaled voltage that is representative of the temperature curvature of the base-emitter voltage $V_{be}$ of a transistor, and which can then be summed to the bandgap reference output to provide a temperature compensated, bandgap reference voltage.

In accordance with another aspect of the present invention, the above method can be carried out in an amplifier circuit configured to receive and sum the temperature curvature compensation voltage and the bandgap reference output voltage into the temperature compensated, bandgap reference voltage.

In accordance with yet another aspect of the present invention, the summing of the temperature curvature compensation voltage and the bandgap reference output voltage may be realized through the application of a dual differential pair amplifier configuration which operates as a $g_m$ source. In addition, scaling of the respective input voltages for each differential pair can be provided by the amplifier circuit.

In accordance with a further aspect of the present invention, the dual differential pair amplifier may be incorporated into a buffer amplifier configuration to receive a bandgap reference voltage and provide a buffered output. Moreover, the dual differential pair may also be integrated with a bandgap reference circuit directly into an amplifier circuit.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF PREFERRED EXEMPLARY EMBODIMENTS OF THE INVENTION

The present invention may be described herein in terms of various functional components and various processing steps. It should be appreciated that such functional components may be realized by any number of hardware or structural components configured to perform the specified functions. For example, the present invention may employ various integrated components, e.g., buffers, supply rail references, current mirrors, and the like, comprised of various electrical devices, e.g., resistors, transistors, capacitors, diodes and the like whose values may be suitably configured for various intended purposes. In addition, the present invention may be practiced in any integrated circuit application where stable voltage references are desired. Such general applications that may be appreciated by those skilled in the art in light of the present disclosure are not described in detail herein. However for purposes of illustration only, exemplary embodiments of the present invention will be described herein in connection with a CMOS operational amplifier. Further, it should be noted that while various components may be suitably coupled or connected to other components within exemplary circuits, such connections and couplings can be realized by direct connection between components, or by connection through other components and devices located therebetween.

As discussed above, previous attempts for compensation for bandgap reference circuits have generally been applicable only for bipolar processes. In addition, previous attempts to provide compensation circuits for CMOS processes have been either too complex or have not resulted in the degree of precision required by today's myriad of applications. However, in this regard, it has been discovered that a more desirable temperature curvature compensation technique can be realized through the addition of a temperature curvature compensation voltage generated by measuring the difference between the base-emitter voltage $V_{be}$ of two different transistors operating at two different temperature coefficient quiescent currents. This voltage difference measured between two such transistors suitably results in a scaled voltage that is representative of the temperature curvature of the base-emitter voltage $V_{be}$ of a transistor, and which can then be summed with the bandgap reference output to provide a temperature compensated, bandgap reference voltage.

Figure 2:
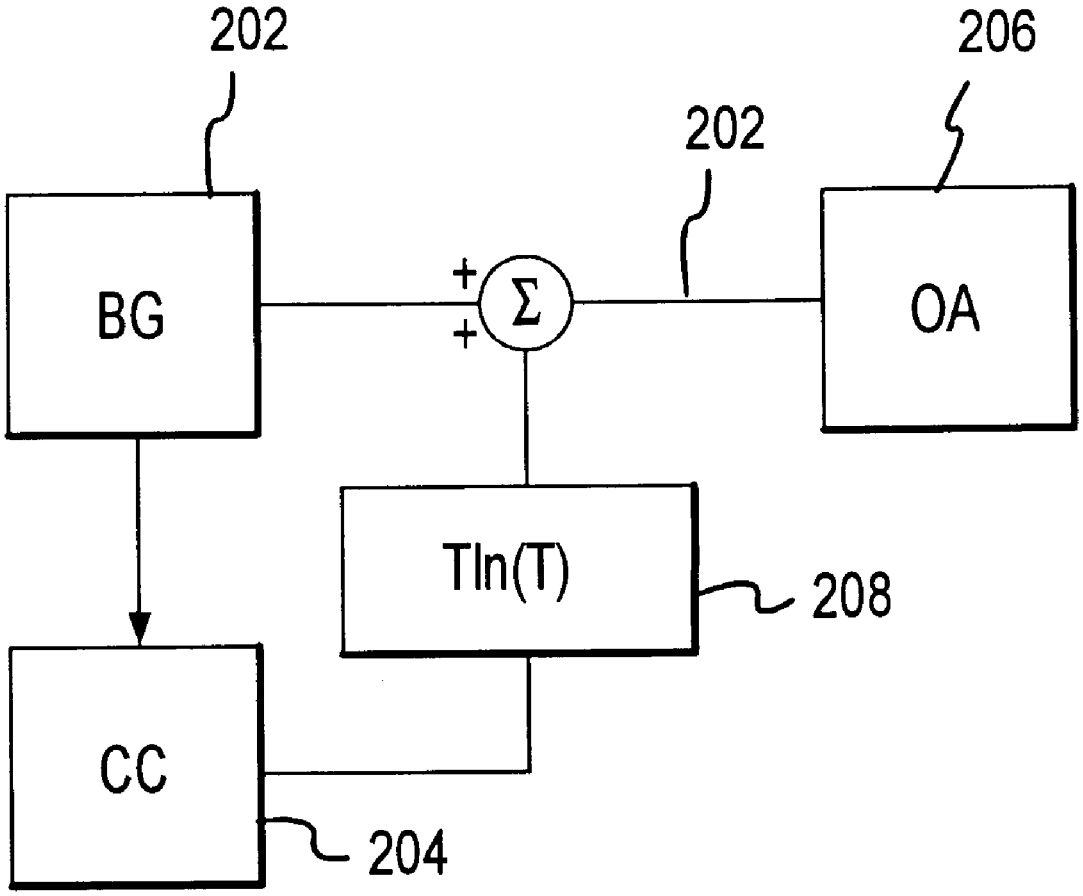
FIG. 2 illustrates a block diagram of an exemplary circuit for providing a voltage reference to an integrated circuit device in accordance with the present invention.

In accordance with one aspect of the present invention, with reference to FIG. 2, a bandgap reference circuit 202 is configured with a temperature curvature compensation circuit 204 to provide a temperature stable voltage reference 205 to an integrated circuit device 206, such as an operational amplifier. In accordance with this aspect, bandgap reference circuit 202 comprises any circuit configured for providing a bandgap reference voltage, such as conventional bandgap reference circuits discussed above, or as will be described in more detail below, an improved bandgap reference circuit.

Curvature compensation circuit 204 is suitably configured to provide a compensation term to be summed with the output of bandgap reference circuit 202 to produce temperature stable voltage reference 205 for integrated circuit device 206. This compensation term may comprise a Tln(T) term that can be generated by various means. Preferably, the compensation term is derived by a circuit that computes the difference between the base-emitter voltage $V_{be}$ of two transistors operating at different temperature coefficient quiescent currents, such as, for example, a PTAT/R current and either a zero or low TC current, or a negative TC current, such as a $V_{be}$/R current.

In accordance with another aspect of the present invention, the compensation term may be added to the output reference of bandgap reference circuit 202 through various means. In accordance with one embodiment, the compensation term may be added by an additional circuit 208 configured to provide a resulting temperature compensated bandgap reference signal to integrated circuit device 206. Circuit 208 may comprise various components and other devices configured to provide a summing function between compensation circuit 204 and bandgap reference circuit 202. As will be described below in more detail below in an exemplary embodiment, circuit 208 may comprise a dual differential pair amplifier arrangement configured for adding the compensation term to the bandgap reference output of bandgap circuit 202.

Figure 1:
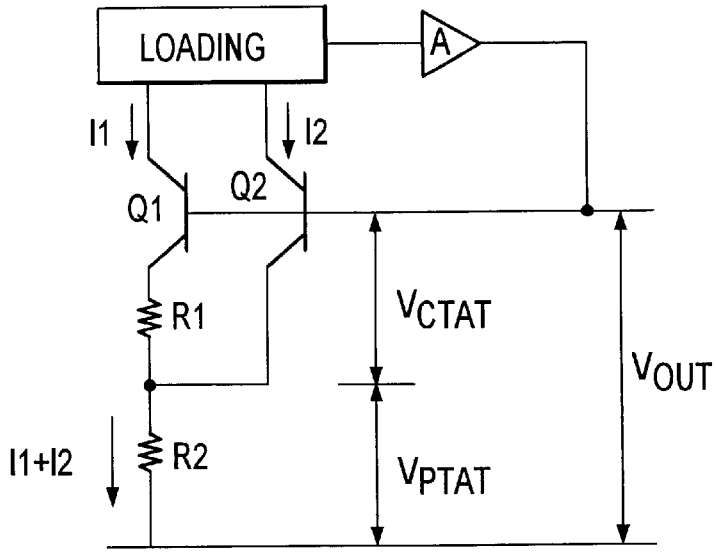
PRIOR ART FIG.1
FIG. 1 illustrates a schematic diagram of a prior art bandgap reference circuit.
Figure 3:
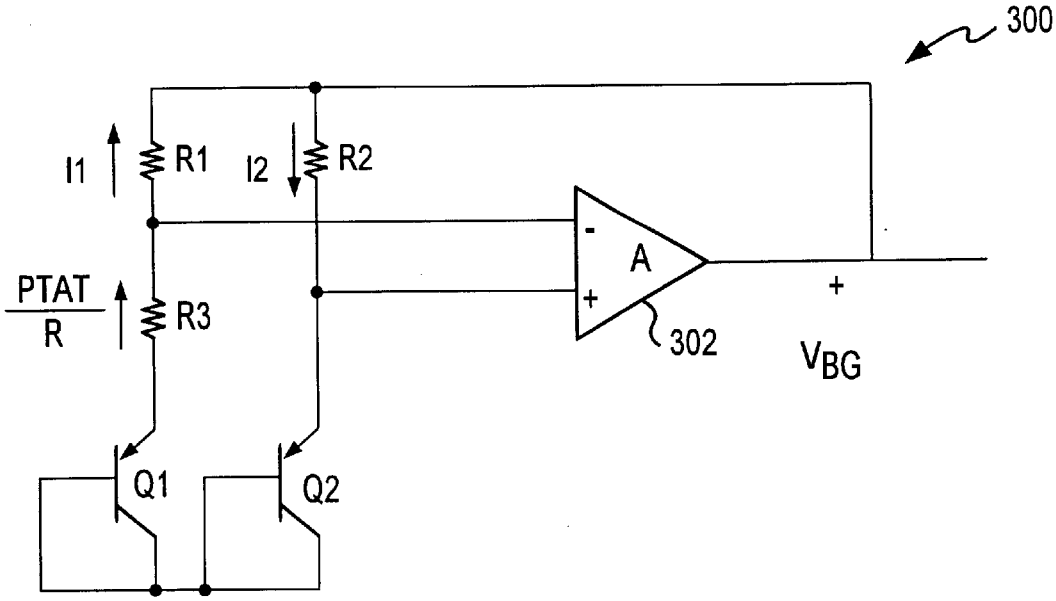
FIG. 3 illustrates a schematic diagram of an exemplary bandgap reference circuit in accordance with the present invention.

Having described in general various aspects of the present invention, a more detailed description using an exemplary embodiment will now be discussed. As discussed above, bandgap reference circuit 202 can comprise various configurations, now known or hereinafter devised, for providing bandgap voltage references. However, to facilitate the explanation of the exemplary embodiment, an illustrative bandgap reference circuit is provided with reference to FIG. 3. In accordance with this exemplary embodiment, a bandgap reference circuit 300 comprises a pair of transistors Q1 and Q2, an operational amplifier 302 and three resistors, R1, R2 and R3. Operational amplifier 302 is suitably configured with resistors R1 and R2 in a feedback arrangement that forces the voltage between the inputs of operational amplifier 302 to approximately zero volts. Resistors R1 and R2 suitably comprise substantially equal value resistors, for example having large resistance values between 50 kΩ and 150 kΩ, that are configured to force equal currents to flow through transistors Q1 and Q2.

Transistors Q1 and Q2 are suitably configured to generate a difference in their respective current densities, i.e., transistors Q1 and Q2 have different sized emitter areas, such that a $\Delta V_{be}$ voltage is generated between transistors Q1 and Q2. This $\Delta V_{be}$ voltage in turn causes a proportional-to-absolute-temperature (PTAT) voltage to exist across resistor R3, and an equal PTAT/R3 current to flow within both transistors Q1 and Q2.

Transistors Q1 and Q2 suitably comprise PNP bipolar transistors in the illustrative embodiment; however transistors Q1 and Q2 can also comprise NPN transistors through appropriate configuration of resistors R1, R2 and R3 and operational amplifier 302. In addition, transistors Q1 and Q2 can be scaled with different sized emitter areas, depending on any number of different design criteria. In accordance with this aspect, the difference in current densities suitably increases the magnitude of the $\Delta V_{be}$ voltage, thus reducing the likelihood that sensitivity errors, such as mismatches and the like, will occur within circuit 300. In accordance with an exemplary embodiment, transistor Q1 is suitably configured with a larger current density than transistor Q2 ranging by a factor of between 5 to 1 and 100 to 1. However, in other embodiments, transistor Q2 can be suitably configured with a larger current density than transistor Q1. Further, the range of scaling for the current densities is not limited to that described in the above exemplary embodiment, and can comprise any range configured to increase or otherwise adjust the magnitude of the $\Delta V_{be}$ voltage.

In addition, while the magnitude of the $\Delta V_{be}$ voltage can be controlled by adjusting the difference in current densities between transistors Q1 and Q2, the magnitude of the $\Delta V_{be}$ voltage can also be suitably increased or decreased to a desirable level by appropriately scaling the values of resistors R1 and R2. For example, making resistor R2 twice as large as resistor R1 could increase the effective current density of transistor Q1 by twice as much as without the scaling of resistors R1 and R2, i.e., with appropriate scaling of resistors R1 and R2, transistor Q1 would not need to have as large an emitter area to obtain the desired increase in the magnitude of the $\Delta V_{be}$ voltage.

As a result, bandgap reference circuit 300 produces a bandgap reference voltage $V_{BG}$ at the output of operational amplifier 302. However, as discussed above, due to the inherent variation that exists for the base-emitter voltage $V_{be}$ of the transistors with respect to temperature, a strong second order term that varies with Tln(T) is generated, and thus the temperature drift performance is limited. However, in accordance with the present invention, a temperature curvature compensation term can be generated by the difference between the base-emitter voltage $V_{be}$ of two different transistors operating at two different quiescent currents to effectively compensate for the second order term that varies Tln(T).

In accordance with this aspect, the difference between the base-emitter voltage $V_{be}$ of two different transistors operating at two different temperature coefficient quiescent currents, i.e., the $\Delta V_{be}$ voltage, can be generated in various circuit configurations. Due to both of transistors Q1 and Q2 operating at equal PTAT/R currents, such a term generating circuit suitably provides at least one additional transistor operating at a different temperature coefficient quiescent current than the PTAT/R current, i.e., provides at least one additional transistor having a different temperature coefficient quiescent current than transistor Q1 or Q2. Moreover, the additional transistor can be configured to operate with various types of currents that are different than the PTAT/R current. For example, the additional transistor can suitably operate with a zero or various low TC currents or negative TC current, such as $V_{be}$/R currents and the like.

Figure 4:
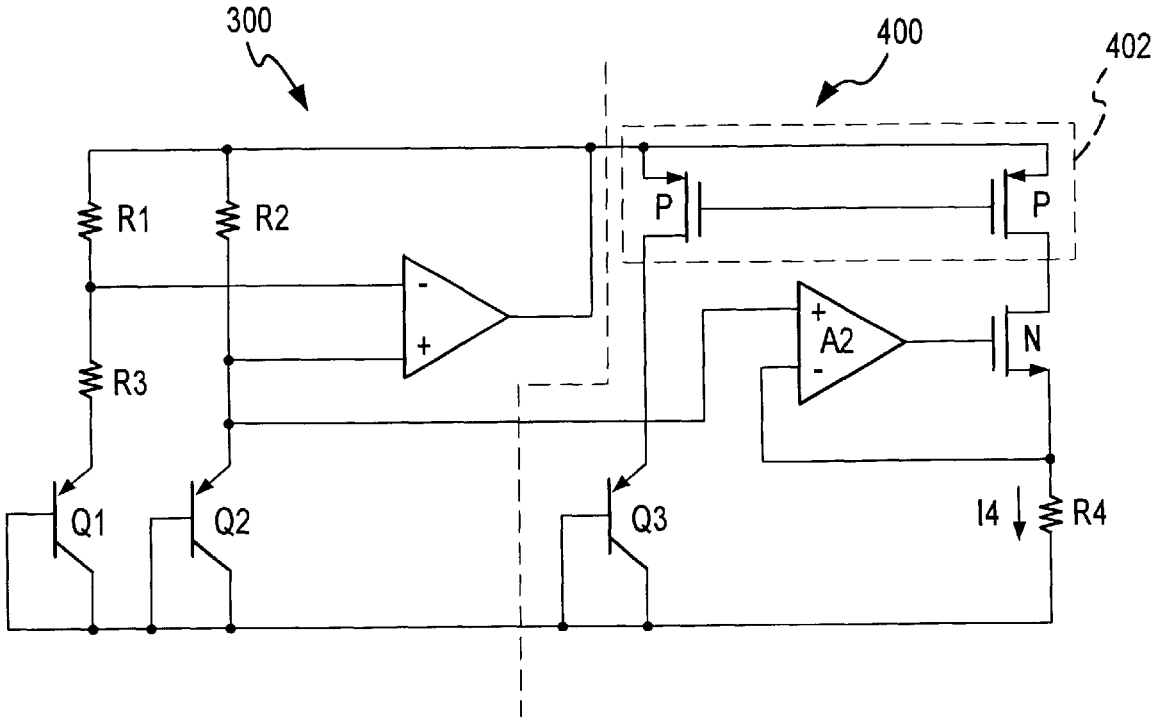
FIG. 4 illustrates a schematic diagram of an exemplary circuit for facilitating a temperature compensation term in accordance with the present invention.

In accordance with an exemplary embodiment, with reference to FIG. 4, an exemplary term generating circuit 400 for providing a second transistor operating at a different quiescent current, i.e., different than a PTAT/R current, is illustrated. Circuit 400 suitably includes a transistor Q3 configured within circuit 400 to provide a second transistor operating at a different quiescent current, for example, a $V_{be}$/R current. In the illustrative embodiment, the different quiescent current can be generated through use of a p-channel current mirror 402, an n-channel transistor N, a fourth resistor R4, and an operational amplifier A2. In this embodiment, operational amplifier A2 receives the $V_{be2}$ voltage of transistor Q2 in one input while the other input is configured in a feedback arrangement. As a result, operational amplifier A2 forces the input voltages to be equal, and thus the $V_{be2}$ voltage of transistor Q2 is applied across resistor R4 to produce a current 14=$V_{be2}$R4. Further, this $V_{be2}$/R4 current flows through transistor N and out its respective drain into p-channel mirror 402, which mirrors the $V_{be2}$/R4 current so that it may also flow into transistor Q3. As a result, transistor Q3 is operating at a different quiescent current, $V_{be2}$/R4, than transistors Q1 and Q2, which are operating with a PTAT/R3 current.

While circuit 400 in the illustrative embodiment suitably utilizes transistor Q2 as the input of operational amplifier A2 to provide the $V_{be}$ voltage across resistor R4, it should be noted that transistor Q1 could be utilized instead of transistor Q2 to provide the $V_{be}$ voltage. Moreover, a combination or some scaled average of the two $V_{be}$ voltages, or other transistor voltages, could be utilized to provide the $V_{be}$ voltage for resistor R4, and the present invention is not limited to the use of any particular transistor for achieving this function.

In addition, while a $V_{be}$/R current is illustrated in circuit 400 to provide a second temperature coefficient quiescent current, other quiescent currents could be utilized as well. For example, a zero or other low TC current could be provided for transistor Q3 to provide a different temperature coefficient than that of transistors Q1 and Q2, and can be realized in various manners. A zero or low TC current, which facilitates a very reliable and accurate circuit, could be suitably provided by adding a PTAT/R current to an appropriately scaled $V_{be}$/R current. Alternatively, by adding a PTAT voltage to a scaled $V_{be}$ voltage, a zero or lower TC current could be realized.

Moreover, various other values of TC current could work as well. For example, current components subject to higher TC values could also be utilized, although using extremely high values can result in difficulty in operating the integrated circuit and bandgap reference circuit at higher temperature.

Accordingly, it is preferable to select the PTAT/R current, which has a TC approximately of 3300 ppm/C°, as the higher TC current, and a zero/low TCR current or a $V_{be}$/R current as the lower end TC current. This selection is particularly desirable since such a PTAT/R current is already generated in the bandgap circuit 300, thus keeping the overall design of the circuit simplified. In addition, the $V_{be}$/R current can be suitably configured with a negative TC value, such as, for example, −2000 or −3000 ppm/C° or any other negative coefficient values, to facilitate maintaining of the quiescent current relatively constant over temperature. However, the $V_{be}$/R current can be suitably configured with other TC values such that a higher and a lower TC exist for the two transistors to be compared.

Accordingly, term generator circuit 400 is suitably configured to provide a second transistor operating at a quiescent current with a temperature coefficient that is different than the temperature coefficient of a first transistor. Having provided such a second transistor having a different temperature coefficient quiescent current, a temperature curvature compensation voltage can be generated by measuring the difference between the base-emitter voltage $V_{be}$ of two different transistors operating at two different temperature coefficient quiescent currents.

Measurement of the difference between the base-emitter voltage $V_{be}$ of two different transistors operating at two different quiescent currents can be accomplished by various means. For example, a comparator circuit can be utilized to measure the two base-emitter voltages and then provide an output representative of the difference in voltage between the two transistors operating at two different quiescent currents. However, any other device that can be suitably configured to measure the two base-emitter voltages and provide an output signal representative of the voltage difference can be utilized in accordance with the present invention to provide a temperature curvature compensation voltage.

Once the temperature curvature compensation voltage is generated, a temperature compensated reference voltage can be provided. In accordance with an exemplary embodiment of the present invention, the temperature curvature compensation voltage can be suitably summed with the bandgap reference voltage in various manners to provide a temperature compensated bandgap reference voltage. As discussed above, circuit 208 may be configured to provide a summing function between compensation circuit 204, comprising for example a term generator circuit 400 and a comparator circuit, and bandgap reference circuit 202, to provide the temperature compensated bandgap reference voltage 205. Moreover, any device or circuit configured for providing a summing function can be utilized in accordance with the present invention to add the temperature curvature compensation voltage with a reference voltage. For example, a conventional summing amplifier circuit may be configured to receive a bandgap reference voltage and a compensation voltage and provided the temperature compensated reference voltage.

While various separate circuit configurations, such as a comparator circuit and a summing amplifier circuit, can be utilized to 1) measure the difference between the base-emitter voltage $V_{be}$ of two different transistors, and then 2) sum the differential voltage, i.e., the temperature compensation voltage, to the bandgap reference circuit, it has been discovered that a single circuit configuration may be preferable in accordance with an exemplary embodiment. For example, in accordance with an exemplary embodiment, circuit 208 may comprise a dual differential pair amplifier configured for summation of the compensation voltage term with the bandgap reference output of bandgap circuit 202.

The dual differential pair amplifier may be suitably configured to compare the base-emitter voltage $V_{be}$ of two different transistors and then add the voltage difference to the bandgap reference voltage to provide a temperature compensated reference voltage. This dual differential pair can be implemented within a variety of applications to facilitate the providing of the temperature compensated reference voltage. For example, with momentary reference to FIG. 6, a dual differential pair may be suitably configured within a buffer amplifier arrangement to suitably measure the voltage differential between the base-emitter voltages of two transistors, such as Q4 and Q3, and then add the differential voltage to a bandgap reference voltage, such as the bandgap reference $V_{BG}$. Further, with momentary reference to FIG. 7, a dual differential pair may also be configured with the bandgap reference circuit included within an amplifier A1 to provide the temperature compensated voltage reference. Moreover, other variations of the dual differential pair can be realized as well, such as, for example, the dual differential pair integrated within the second stage of a feedback amplifier. Accordingly, the use of the dual differential pair is not limited to those described herein.

A dual differential pair in accordance with the present invention can be configured in numerous arrangements. In accordance with an exemplary embodiment, a dual differential pair is suitably configured with an amplifier to provide a dual differential pair amplifier circuit. In this exemplary embodiment, the difference voltage, i.e., the voltage difference between the base-emitter voltages of two different transistors operating at two different quiescent currents, is suitably applied to one pair of inputs of the dual differential pair amplifier to induce the difference voltage in the input offset voltage of the other pair of inputs, which are suitably configured with a bandgap reference circuit. Accordingly, as will be described in more detail below, by appropriately scaling the contribution of the offset curvature voltage to the output of the voltage reference circuit, such as a bandgap reference circuit, nearly perfect correction and linear temperature drift can be realized.

Figure 5:
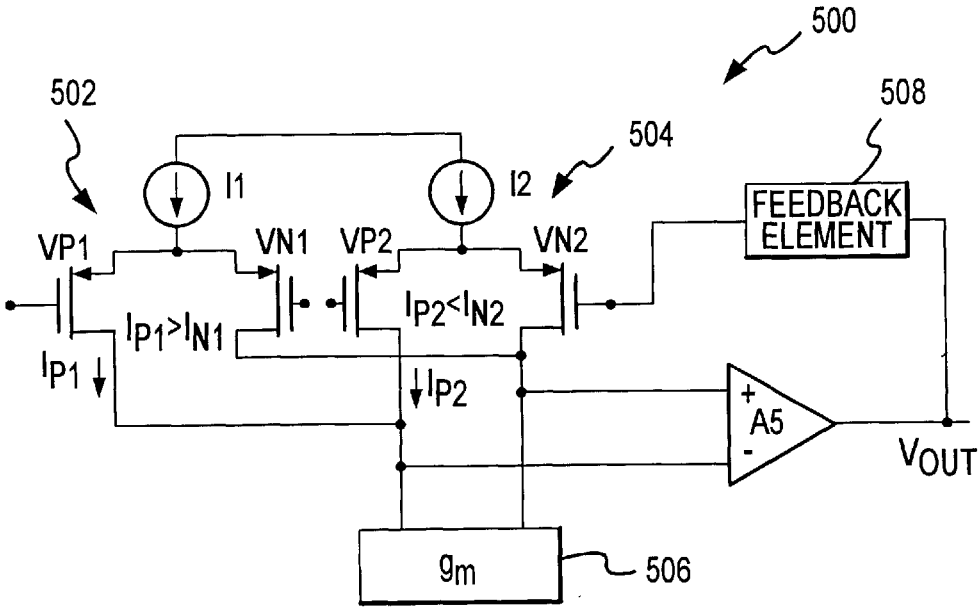
FIG. 5 illustrates a schematic diagram of an exemplary circuit for providing a temperature curvature compensation term to a bandgap reference circuit in accordance with the present invention.

With reference to FIG. 5, an exemplary embodiment of a dual differential pair with an amplifier is illustrated. In accordance with this exemplary embodiment, a first differential pair 502, comprising transistors P1 and N1 and having a current source I1, is configured with a second differential pair 504, comprising transistors P2 and N2 and having a current source I2, with both pairs coupled to a current mirror component 506, and an amplifier A5. Each differential pair 502 and 504 comprises a pair of MOSFETs, with each pair having a pair of input terminals, e.g., the gates of each transistor within pairs 502 and 504. In addition, each differential pair 502 and 504 has currents flowing therein, for example, currents $I_{P1}$, and $I_{N1}$, and currents $I_{P2}$ and $I_{N2}$, respectively. Further, these currents of differential pairs 502 and 504 are suitably summed together with current mirror component 506 into amplifier A5. Accordingly, an operational amplifier circuit 500 having four input terminals, two positive and two negative, can be realized.

In accordance with one aspect of the present invention, current mirror component 506 suitably comprises a current mirror circuit configured to provide suitable matching of input currents provided by differential pairs 502 and 504. In addition, current mirror component 506 can comprise any current mirror configuration, now known or hereinafter devised.

One characteristic of operational amplifier circuit 500 is that amplifier A5 is suitably configured with differential pair 502 and differential pair 504 such that if a differential voltage, such as the temperature curvature compensation voltage, is applied to the input terminals of one differential pair, the input voltage at the input terminals of the second differential pair would need to comprise the same magnitude but opposite polarity as the first differential pair to provide amplifier A5 with a zero output voltage. In other words, with the addition of a feedback element 508 configured with amplifier A5 in a feedback arrangement, as a differential voltage is applied to the input terminals of differential pair 502, and the feedback output of amplifier A5 is applied through feedback element 508 to the input terminals of differential pair 504, the input terminals of differential pair 504 will comprise a differential voltage having the same magnitude but opposite polarity as the differential voltage of differential pair 502, i.e., an input offset voltage is realized at the inputs of differential pair 504 and will appear in the output voltage $V_{OUT}$ according to the noise gain of operational amplifier circuit 500.

For example, if a voltage source is applied differentially across the input terminals of differential pair 502, with the positive source connected to P1 and ground connected to N1, currents IP1 and IN1 will flow through to current mirror 506. In addition, when the voltage source is a negative voltage, i.e., when the voltage at VP1 is less than the voltage at VN1, the current in IP1 will be greater than the current in IN1. Since current mirror 506 suitably operates to provide equal currents flowing from differential pairs 502 and 504, the current in IP2 will be less than IN2 by the same amount to satisfy current mirror 506 and feedback element 508 of amplifier A5, i.e., the voltage in VP2 will be greater than the voltage at VN2. Moreover, if a positive voltage source is applied across terminals PI and N1, the results are similar, e.g., the voltage at VP1 is greater than the voltage at VN1, and the current in IP1 will be less than the current in IN1.

In accordance with another aspect, current sources I1 and I2 are suitably configured to provide effective scaling of the voltage sources at the input terminals of differential pairs 502 and 504, and thus permit one voltage source to be more effective than the other voltage source in determining the voltage output $V_{OUT}$ of amplifier A5, i.e., the magnitude of the effective input offset voltage of one differential pair may be suitably scaled depending on desired performance criteria. For example, when current source I1 is five times greater than current source I2, then the input voltage at differential pair 502, i.e., at input terminals P1 and N1, will be five times more effective than the input voltage at differential pair 504 in determining the output voltage $V_{OUT}$. On the other hand, if the current source I2 is six times greater than current source I1, then the input voltage at differential pair 504, i.e., at input terminals P2 and N2, will be six times more effective than the input voltage at differential pair 504 in determining the output voltage $V_{OUT}$. Moreover, the scaling of current sources can be suitably selected from various parameters, for example, from zero or equal scaling to scaling factors of ten or more, depending on various process design characteristics. Further, scaling of the current sources can be utilized regardless of whether differential pairs 502 and 504 comprise bipolar transistors, or MOSFETs as shown in the exemplary embodiment. Moreover, although in an exemplary embodiment current source I1 is effectively scaled to a value between five and seven times current source I2, other scaling variations are equally plausible.

Accordingly, the relative $g_m$ contribution of each differential pair 502 and 504 may be scaled by suitably configuring current sources I1 and I2. However, various other means for effective scaling of the $g_m$ contribution can be utilized in accordance with the present invention. For example, in the exemplary embodiment where operational amplifier circuit 500 comprises MOSFETs for differential pairs 502 and 504, the effective scaling can be suitably configured by scaling the effective size transistor device areas to provide effective scaling of the current flowing through transistors P1 and N1, and through transistors P2 and N2.

In addition, effective scaling of the $g_m$ contribution of differential pairs 502 and 504 can be realized by suitably implementing degeneration resistors in series with one or both differential pairs 502 and 504, and thus further increasing the linear range of the $g_m$ contribution for either or both differential pairs 502 and 504. For example, for differential pairs 502 and 504 configured with bipolar transistors, emitter degeneration resistors could be configured to provide decreased $g_m$ contribution. For MOSFETs, degeneration resistors can be suitably configured with the source of the transistors to provide increase linear range of the $g_m$ contribution.

Moreover, operational amplifier circuit 500 is not limited to use of any one of the above techniques for effective scaling of the $g_m$ contribution for differential pairs 502 and 504. For example, both the scaling of current sources I1 and I2 and the scaling of the size of transistor device areas can be utilized in accordance with various embodiments of the present invention. In addition, degeneration resistors can be suitably utilized with each of the above methods for scaling the $g_m$ contribution, or with both the scaling of current sources I1 and I2 and the transistor device areas methods. Moreover, any of the above methods for effective scaling of the $g_m$ contribution can be suitably applied to one or both differential pairs 502 and 504 depending on any number of design and performance criteria.

The above described operation of an exemplary dual differential pair amplifier 500 illustrates one $g_m$ source that is suitable for use in summing and scaling two differential voltages, such as a bandgap reference voltage and a temperature curvature compensated voltage, to provide a temperature compensated output voltage. However, it should be noted that any other $g_m$ source which is suitably configured to generate an output current proportional to an input voltage for two circuits, with the two circuits configured such that the input voltage applied to one circuit causes the other circuit to have an equal offset voltage applied to its input, may also be utilized in accordance with various exemplary embodiments of the present invention.

Accordingly, dual differential pair amplifier 500 may be suitably configured to compare the base-emitter voltage $V_{be}$ of two different transistors and then add the voltage difference to the bandgap reference voltage to provide a temperature compensated reference voltage. In addition, other $g_m$ sources can be utilized to perform this function. Moreover, dual differential pair amplifier 500 can be implemented within a variety of applications to facilitate the providing of the compensated reference voltage.

Figure 6:
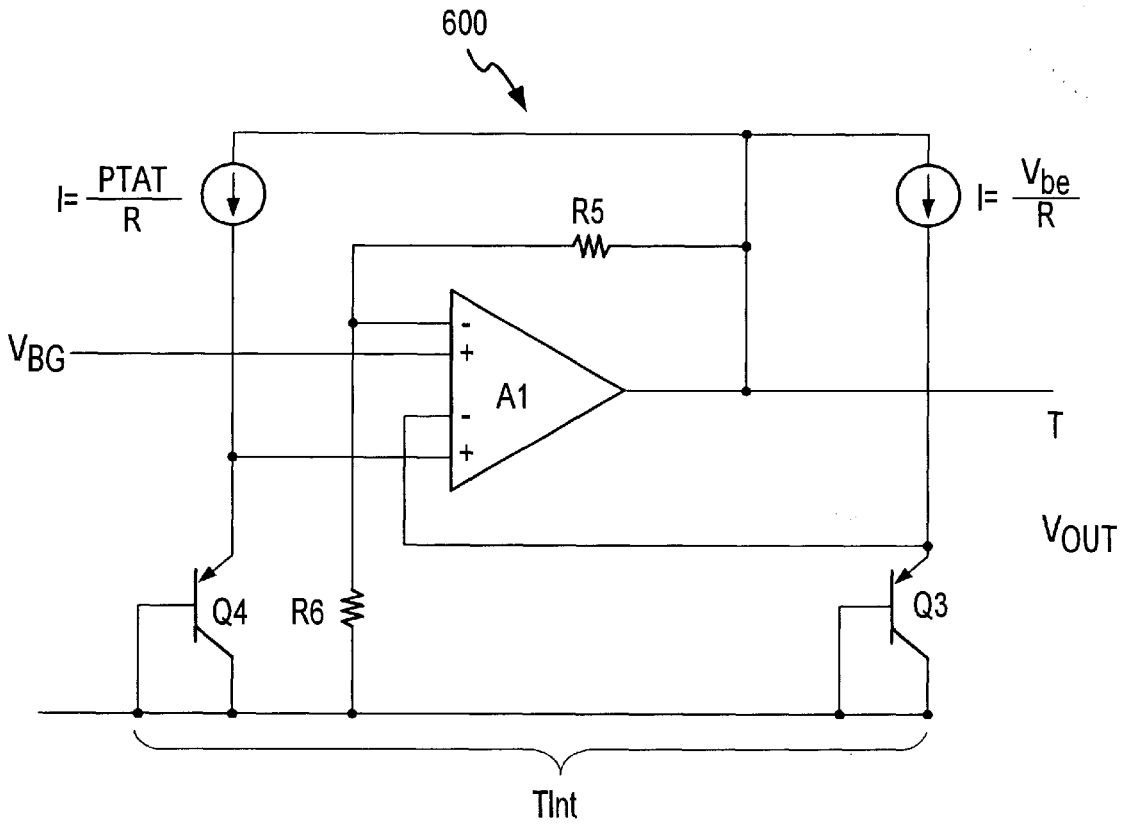
FIG. 6 illustrates an embodiment of an exemplary bandgap reference circuit in accordance with the present invention.

With reference to FIG. 6, wherein A1 is a circuit such as FIG. 5, in accordance with an exemplary embodiment, differential pairs 502 and 504 may be suitably configured within a buffer amplifier arrangement to suitably provide a temperature compensated reference voltage. Such an arrangement may be preferable in instances where a buffer amplifier is desired to buffer and/or scale the output of a bandgap reference circuit prior to summing the bandgap reference voltage with the temperature curvature compensation voltage. In accordance with this exemplary embodiment, a buffer amplifier configuration 600 suitably includes an amplifier A1 configured with resistors R5 and R6. Amplifier A1 suitably comprises dual differential inputs, and may be suitably configured as dual differential amplifier 500.

In accordance with one aspect, the function of buffer amplifier configuration 600 is to suitably measure the voltage differential between two transistors, such as Q4 and Q3, and then add the differential voltage to a reference voltage, such as a bandgap reference $V_{BG}$, to provide a temperature compensated reference voltage $V_{OUT}$. To provide the temperature compensated reference voltage $V_{OUT}$, amplifier A1 is suitably configured with the positive input of one pair of differential inputs suitably coupled with a reference voltage, such as bandgap reference $V_{BG}$, with the negative terminal of that pair of differential inputs coupled to a feedback network of amplifier A1, comprising resistors R5 and R6. As a result of the feedback network, a portion of the output reference voltage $V_{OUT}$ resulting from one pair of differential inputs will be equal to:

$$V_{OUT}=(1+R5/R6)\times V_{BG}$$

The second pair of differential inputs of amplifier A1 is suitably connected to transistors Q3 and Q4 which are configured to provide two different base-emitter voltages $V_{be}$ operating at two different quiescent currents, for example, a $V_{be}/R$ current and a PTAT/R current, respectively. Accordingly, by providing transistors Q3 and Q4 across the second pair of differential input terminals, such as terminals P1 and N1 of differential pair amplifier 500, the temperature curvature compensated voltage, i.e., the Tln(T) voltage term, is applied to amplifier A1 for summation with the reference voltage applied to the first pair of differential inputs. In addition, the Tln(T) term, i.e., the difference in base-emitter voltages $V_{be}$ of transistors Q4 and Q3 operating at two different quiescent currents, is suitably scaled by the $g_m$ contribution of the two pairs, such as is described in differential pair amplifier 500. Further, as a result of the feedback network, the portion of the output reference voltage $V_{OUT}$ resulting from this second pair of differential inputs will be equal to:

$$V_{OUT}=(1+R5/R6)\times(V_{BE4}-V_{BE3})$$

As a result, the total summation of the two voltage inputs into differential pair amplifier A1, and the resulting operation of the associated gain functions, provides the following equation:

$$V_{OUT}=k_1(1+R5/R6)\times V_{BG}+k_2(1+R5/R6)\times(V_{BE4}-V_{BE3})$$

Moreover, although not explicitly shown in the above equation, it should be noted that due to the existence of a residual artifacts within the $\Delta V_{be}$ voltage, the output voltage $V_{OUT}$ suitably includes an additional linear term. In addition, gain terms k, and $k_2$ may also be included with the equation which result from other gain characteristics of the circuit. Accordingly, the temperature coefficient of the bandgap reference voltage can be suitably adjusted to compensate for the effects of such a linear term.

Accordingly, differential pairs 502 and 504 may be suitably configured within a buffer amplifier arrangement, wherein a reference voltage can be suitably buffered and/or scaled to suitably provide a temperature compensated reference voltage. Thus, for example, if a 1.25 volt bandgap reference voltage is provided to the input of buffer amplifier 600, a resulting temperature compensated reference voltage of 2.5 volts can be realized. Further, it should be noted that transistor Q4, which provides a base-emitter voltages $V_{be}$ for comparison to transistor Q3, could be suitably replaced by an existing transistor within the bandgap reference circuit providing an input to buffer amplifier 600.

Figure 7:
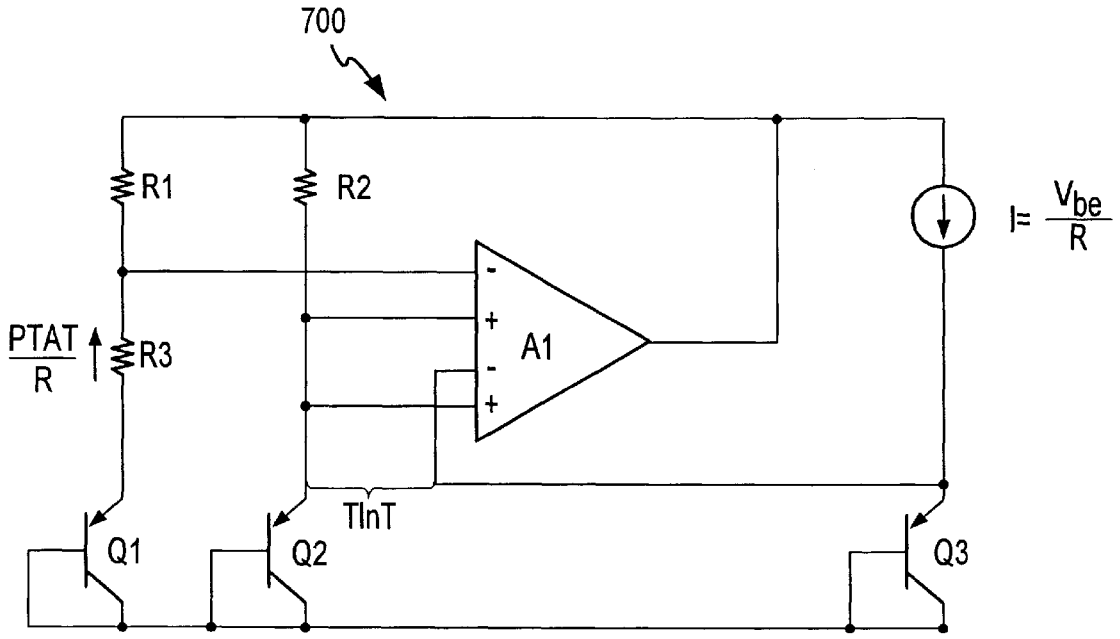
FIG. 7 illustrates another embodiment of an exemplary bandgap reference circuit in accordance with the present invention.

In accordance with another exemplary embodiment, rather than having a bandgap reference followed by a buffer amplifier as illustrated in FIG. 6, differential pairs 502 and 504 may also be configured within an amplifier circuit having a bandgap reference circuit directly incorporated within. For example, as discussed above with reference to a circuit 500, an amplifier AS may suitably include feedback element 508 configured within a feedback arrangement and coupled to the N2 input terminal of differential pair 504, with the input terminals P2 and N2 realizing a differential voltage having the same magnitude but opposite polarity as the input terminals P1 and N1 of differential pair 502. In accordance with an exemplary embodiment having a bandgap reference circuit directly incorporated within an amplifier circuit, feedback element 508 may suitably comprise a portion of a bandgap reference circuit, for example, transistor Q1 and resistors R1 and R3, suitably coupled to the N2 terminal, while transistor Q2 and resistor R2 suitably coupled to the P2 terminal. With reference to FIG. 7, an exemplary embodiment of such a circuit is illustrated.

In accordance with this exemplary embodiment, an amplifier circuit 700 suitably includes amplifier A1, for example a dual differential amplifier. In addition, amplifier A1 is suitably configured such that one pair of differential inputs, for example, P2 and N2, are suitably coupled to transistors Q1 and Q2 and resistors R1, R2 and R3, e.g., a bandgap reference circuit 300. Further, the second pair of differential inputs, for example, P1 and N1, can be suitably coupled to two transistors having different temperature coefficients, such as Q2 having a PTAT/R current and Q3 having a $V_{be}/R$ current, or another current provided by term generating circuit 400. Accordingly, one pair of differential inputs can receive a voltage reference, while the second pair of differential inputs can receive a temperature curvature compensation voltage, i.e., one having a Tln(T) term. As a result of the feedback arrangement, any offset voltage realized by the second differential pair will be inverted and realized by the first differential pair, with or without suitable scaling by the effective $g_m$ contributions within dual differential amplifier A1, to provide a temperature compensated reference voltage $V_{OUT}$.

While the above embodiment illustrates a bandgap reference circuit configured within amplifier A1, it should be noted that any other reference voltage can be incorporated within a feedback amplifier arrangement and coupled to a first pair of differential input terminals, with the second pair of differential input terminals suitably coupled to a compensating voltage having a Tln(T) term. Moreover, while the exemplary embodiment of circuit 700 illustrates transistor Q2 utilized with transistor Q3 to develop a differential voltage, additional or other transistors could be suitably utilized so long as the difference between the base-emitter voltage $V_{be}$ of two different transistors operating at two different quiescent currents is provided.

Figure 8:
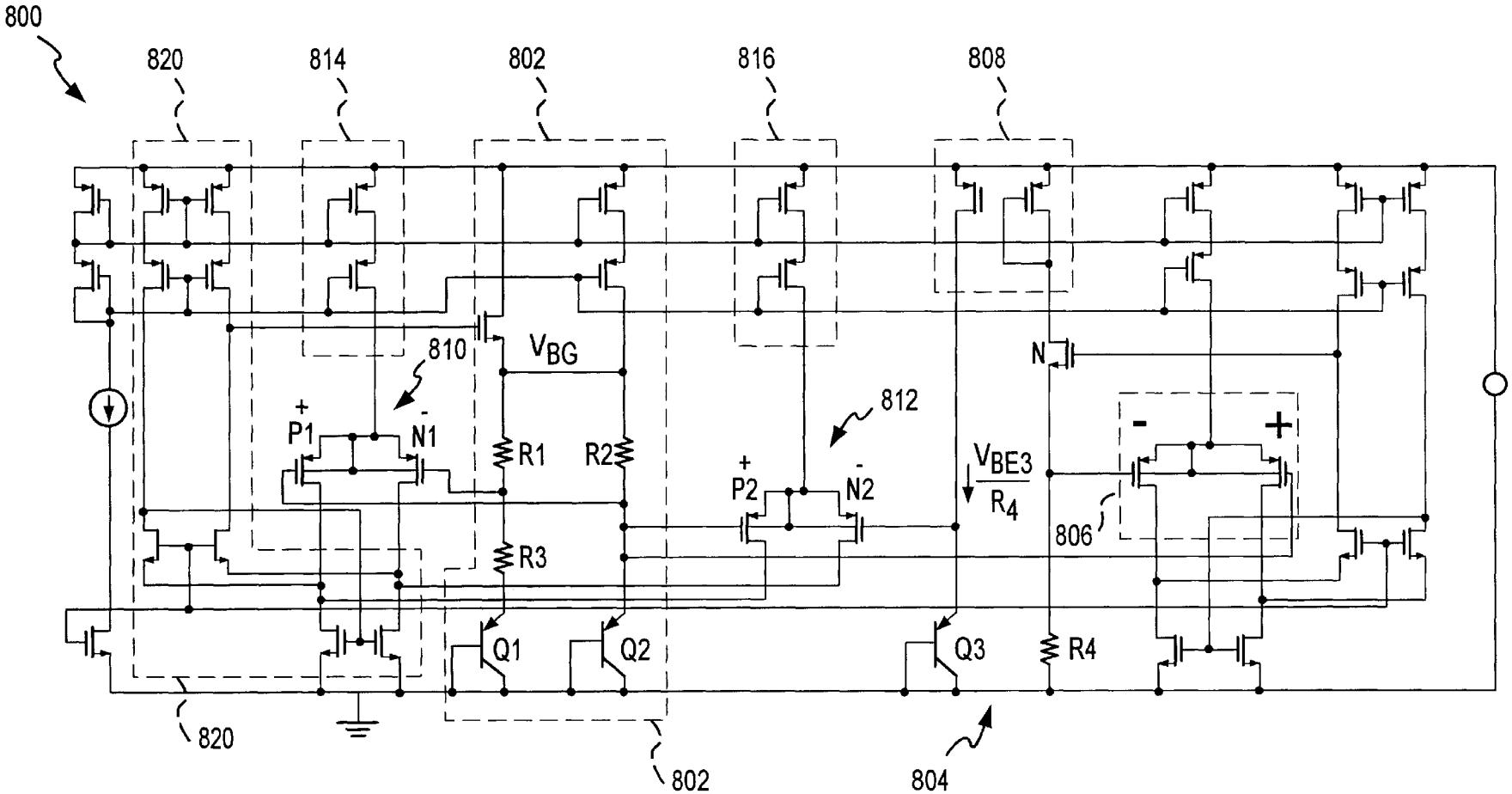
FIG. 8 illustrates an exemplary circuit having various embodiments combined for providing a temperature compensated reference voltage in accordance with the present invention.

Having described various components and embodiments that may be used alone or in combination to provide a temperature curvature compensated reference voltage, an exemplary schematic embodiment illustrating various components combined into a circuit for generating a temperature compensated bandgap reference can now be shown. With reference to FIG. 8, an exemplary circuit 800 suitably includes a bandgap reference circuit 802 coupled with a term generating circuit. Bandgap reference circuit 802 can suitably comprise any known bandgap reference circuit, or can comprise bandgap reference circuit 300, such that a bandgap reference voltage $V_{BG}$ can be generated. The term generating circuit suitably comprises an amplifier 806, a current mirror 808 and transistor Q3 and resistor R4. The positive terminal of amplifier 806 is preferably connected to a base-emitter voltage $V_{be}$, for example transistors Q1 or Q2, to provide a $V_{be}$ voltage across resistor R4, comprising for example a 150 kΩ resistor. As such, the corresponding $V_{be}/R4$ current can be suitably mirrored by current mirror 808 to provide a $V_{be}/R4$ current flowing through transistor Q3.

In addition, circuit 800 suitably includes a first differential pair 810, having a first current source 814, and a second differential pair 812, having a second differential source 816.

First differential pair 810 is suitably coupled to bandgap reference circuit 802, while second differential pair is coupled between a transistor having a PTAT/R current, for example, Q1 or Q2, and transistor Q3 having a different quiescent current flowing therein. In addition, first differential pair 810 and second differential pair 812 are suitably coupled to a current mirror/amplifier component 820, such as current mirror component 506.

Accordingly, for any reference voltage generated at a terminal $V_{BG}$, circuit 800 can utilize the temperature compensation voltage, e.g., the difference in base-emitter voltages for transistors Q2 and Q3, to suitably adjust the offset voltage of first differential pair 810 to achieve a temperature compensated reference voltage. In addition, the gain of the curvature compensation can be suitably adjusted by various methods previously disclosed herein, for example, by adjusting the size of the transistors within second differential pair 812 relative to first differential pair 810, or by suitably adjusting the current in current source 816 relative to the current in current source 814.

The present invention has been described above with reference to an exemplary embodiment. However, those skilled in the art will recognize that changes and modifications may be made to the exemplary embodiment without departing from the scope of the present invention. For example, the various components may be implemented in alternate ways, such as, for example, by comparing the $V_{be}$ voltage of transistor Q3 with any other transistor within the circuit, rather than comparing the $V_{be}$ voltage to transistors Q1 or Q2, to generate the difference voltage. Moreover, rather than the use of a negative TC current for transistor Q3, such as a $V_{be}$/R current, a higher TC current of 5000 ppm/C or more could be utilized for transistor Q3, wherein the secondary inputs of amplifier A1 would be suitably reversed to account for changes in polarity. These alternatives can be suitably selected depending upon the particular application or in consideration of any number of factors associated with the operation of the system. In addition, the techniques described herein may be extended or modified for use with other integrated circuits separate from an operational amplifier. These and other changes or modifications are intended to be included within the scope of the present invention, as expressed in the following claims.

What is claimed is:

1. A method for providing a temperature compensated reference voltage, said method comprising the steps of:

generating a voltage reference signal;

generating a first temperature coefficient quiescent current in a first transistor;

generating a second temperature coefficient quiescent current in a second transistor; said second temperature coefficient quiescent current having a different temperature coefficient value than said first temperature coefficient quiescent current;

comparing a base-emitter voltage of said first transistor with a base-emitter voltage of said second transistor through use of a dual differential pair configuration to generate a temperature compensation voltage; and summing said temperature compensation voltage with said voltage reference signal through use of a dual differential pair configuration to provide said temperature compensated reference voltage.

2. A method according to claim 1, wherein said step of summing comprises scaling $g_m$ contributions of said temperature compensation voltage and said voltage reference signal through use of said dual differential pair configuration to provide said temperature compensated reference voltage.

3. A method according to claim 2, wherein said step of scaling said $g_m$ contributions comprises scaling a pair of current sources configured within said dual differential pair configuration.

4. A method according to claim 2, wherein said step of scaling said $g_m$ contributions comprises scaling transistor device areas within said dual differential pair configuration.

5. A method according to claim 2, wherein said step of scaling said $g_m$ contributions comprises utilizing degeneration resistors within said dual differential pair configuration.

6. A method according to claim 1, wherein said step of generating said first temperature coefficient quiescent current in said first transistor comprises generating a PTAT/R current.

7. A method according to claim 1, wherein said step of generating said second temperature coefficient quiescent current in said second transistor comprises generating a temperature coefficient quiescent current having a lower temperature coefficient value than said first temperature coefficient quiescent current.

8. A method according to claim 7, wherein said step of generating said second quiescent current in said second transistor comprises generating a $V_{be}$/R current.

9. A method for temperature curvature compensation, said method comprising the steps of:

generating a first temperature coefficient quiescent current in a first device;

generating a second temperature coefficient quiescent current in a second device having a different temperature coefficient value than said first temperature coefficient quiescent current in said first device;

comparing a voltage of said first device with a voltage of said second device through use of a dual differential pair configuration to generate a temperature compensation voltage.

10. A method according to claim 9, wherein said method further comprises the steps of:

summing said temperature compensation voltage with a voltage reference signal through use of said dual differential pair configuration to provide a temperature compensated reference voltage.

11. A method according to claim 10, wherein said step of summing comprises scaling $g_m$ contributions of said temperature compensation voltage and said voltage reference signal through use of said dual differential pair configuration to provide said temperature compensated reference voltage.

12. A method according to claim 11, wherein said step of scaling said $g_m$ contributions comprises scaling a pair of current sources configured within said dual differential pair configuration.

13. A method according to claim 11, wherein said step of scaling said $g_m$ contributions comprises scaling transistor device areas within said dual differential pair configuration.

14. A method according to claim 11, wherein said step of scaling said $g_m$ contributions comprises utilizing degeneration resistors within said dual differential pair configuration.

15. A voltage reference circuit for providing a temperature compensated reference voltage, said voltage reference circuit comprising:

a bandgap reference circuit for generating a bandgap reference voltage and having a first transistor, said first transistor having a first base-emitter voltage and a first temperature coefficient quiescent current;

a curvature compensation circuit having a second transistor, said second transistor having a second base-emitter voltage and a second temperature coefficient quiescent current, said second temperature coefficient quiescent current having a different temperature coefficient value than said first temperature coefficient quiescent current, and a dual differential pair amplifier circuit for comparing said first base-emitter voltage and said second base-emitter voltage to generate a differential voltage, and for summing said differential voltage with said bandgap reference voltage to provide said temperature compensated reference voltage.

16. A voltage reference circuit according to claim 15, wherein said dual differential pair amplifier circuit further comprises a $g_m$ source configured to provide said temperature compensated reference voltage.

17. A voltage reference circuit according to claim 16, wherein said dual differential pair amplifier circuit is configured for scaling $g_m$ contributions of said differential voltage and said bandgap reference voltage to provide said temperature compensated reference voltage.

18. A voltage reference circuit according to claim 16, wherein said dual differential pair amplifier circuit comprises a pair of current sources configured for scaling said $g_m$ contributions of said differential voltage and said bandgap reference voltage.

19. A voltage reference circuit according to claim 16, wherein said dual differential pair amplifier circuit comprises transistors having device areas configured for scaling said $g_m$ contributions of said differential voltage and said bandgap reference voltage.

20. A voltage reference circuit according to claim 16, wherein said dual differential pair amplifier circuit comprises degeneration resistors configured for scaling said $g_m$ contributions of said differential voltage and said bandgap reference voltage.

21. A voltage reference circuit according to claim 15, wherein said dual differential pair amplifier circuit includes a current mirror circuit configured for matching of input currents within said dual differential pair amplifier circuit.

22. A voltage reference circuit according to claim 15, wherein said dual differential pair amplifier circuit is configured in a buffer amplifier arrangement for buffering said bandgap reference voltage prior to summation of said bandgap reference voltage with said differential voltage.

23. A voltage reference circuit according to claim 15, wherein dual differential pair amplifier circuit is configured within said bandgap reference circuit to provide summation of said bandgap reference voltage with said differential voltage.

24. A temperature compensation circuit for providing a temperature compensated voltage signal, said temperature compensation circuit comprising:

a first device having a first temperature coefficient quiescent current;

a second device having a second temperature coefficient quiescent current different than said first temperature coefficient quiescent current; and a dual differential pair amplifier for receiving a differential voltage between a voltage of said first device and a voltage of said second device, and for facilitating summation of said differential voltage with a voltage reference to provide said temperature compensated voltage signal.

25. A temperature compensation circuit according to claim 24, wherein said dual differential pair amplifier is configured for scaling $g_m$ contributions of said differential voltage and said voltage reference to provide said temperature compensated voltage signal.

26. A voltage reference circuit according to claim 25, wherein said dual differential pair amplifier comprises a pair of current sources configured for scaling said $g_m$ contributions of said differential voltage and said voltage reference.

27. A voltage reference circuit according to claim 25, wherein said dual differential pair amplifier comprises transistors having device areas configured for scaling said $g_m$ contributions of said differential voltage and said voltage reference.

28. A voltage reference circuit according to claim 25, wherein said dual differential pair amplifier comprises degeneration resistors configured for scaling said $g_m$ contributions of said differential voltage and said voltage reference.

29. A voltage reference circuit according to claim 24, wherein said dual differential pair amplifier includes a current mirror circuit configured for matching of input currents within said dual differential pair amplifier.

30. An amplifier circuit for providing a temperature compensated reference voltage, said amplifier circuit comprising:

a voltage reference generating circuit for generating a reference voltage;

a first transistor having a first base-emitter voltage and a first temperature coefficient quiescent current;

a term generating circuit comprising a second transistor, said second transistor having a second base-emitter voltage and a second temperature coefficient quiescent current, said second temperature coefficient quiescent current having a different temperature coefficient value than said first temperature coefficient quiescent current; and a dual differential pair configuration for computing a temperature compensation voltage comprising a differential voltage between said first base-emitter voltage and said second base-emitter voltage, and summing said temperature compensation voltage and said reference voltage to provide said temperature compensated reference voltage.

31. An amplifier circuit according to claim 30, wherein said term generating circuit comprises:

a second amplifier circuit configured in a feedback arrangement;

a current mirror circuit configured between said second transistor and a resistor; and wherein said temperature compensation circuit is configured to apply a base-emitter voltage across said resistor to produce said second temperature coefficient quiescent current flowing within said second transistor.

32. An amplifier circuit according to claim 30 wherein said first transistor is configured within said voltage reference generating circuit.

33. An amplifier circuit according to claim 32, wherein said voltage reference generating circuit comprises a bandgap reference circuit, and wherein said first temperature coefficient quiescent current comprises a PTAT/R quiescent current.

34. An amplifier circuit according to claim 32, wherein said second temperature coefficient quiescent current comprises a $V_{be}/R$ quiescent current.

35. A voltage reference circuit for providing a temperature compensated reference voltage, said voltage reference circuit comprising:

a bandgap reference circuit for generating a bandgap reference voltage;

a first transistor having a first base-emitter voltage and a first temperature coefficient quiescent current;

a compensation term generating circuit, said compensation term generating circuit comprising:

a second amplifier configured in a feedback arrangement;

a second transistor having a second base-emitter voltage and a resistor; and a current mirror configured between said second transistor and said resistor, and wherein said compensation term generating circuit generates a second temperature coefficient quiescent current flowing within said second transistor; said second temperature coefficient quiescent current having a different temperature coefficient value than said first temperature coefficient quiescent current; and a dual differential pair amplifier for receiving a differential voltage comprising a difference between said first base-emitter voltage and said second base-emitter voltage, and summing said differential voltage with said bandgap reference voltage to provide said temperature compensated reference voltage.

* * * * *